United States Patent [19]

Fischer

[11] 4,141,657

[45] Feb. 27, 1979

[54] BLENDING APPARATUS

[75] Inventor: John J. Fischer, Stroudsburg, Pa.

[73] Assignee: Harsco Corporation, Pa.

[21] Appl. No.: 831,096

[22] Filed: Sep. 1, 1977

[51] Int. Cl.[2] ..... B01F 9/02

[52] U.S. Cl. ..... 366/232

[58] Field of Search ..... 366/220, 230, 235, 183, 366/170, 135, 173; 134/159; 68/144, 145; 51/164 R

[56] References Cited

U.S. PATENT DOCUMENTS

| | | | |
|---|---|---|---|
| 2,514,126 | 7/1950 | Fischer | 366/220 |
| 3,134,578 | 5/1964 | Anderson | 366/235 |
| 3,341,182 | 9/1967 | Fischer | 366/183 |
| 3,362,688 | 1/1968 | Fischer | 366/170 |
| 3,388,893 | 6/1968 | Hall | 366/135 |
| 3,397,067 | 8/1968 | Galle | 426/622 |
| 3,552,724 | 1/1971 | Thomsen | 366/235 |
| 3,578,002 | 5/1971 | Rowan | 134/159 |
| 3,635,443 | 1/1972 | Fischer | 366/173 |

FOREIGN PATENT DOCUMENTS

| | | | |
|---|---|---|---|
| 766639 | 1/1957 | United Kingdom | 366/235 |

OTHER PUBLICATIONS

Bulletin PED-2, Patterson-Kelley Company, Patterns of Precision in Processing Equipment, Copyright 1976.

*Primary Examiner*—Robert W. Jenkins

*Attorney, Agent, or Firm*—Cameron, Kerkam, Sutton, Stowell & Stowell

[57] ABSTRACT

A dual shell rotational blending apparatus which is formed by two hollow cylindrical leg sections joined at one end to form a closed apex portion. One cylindrical leg section has a mean length greater than the other leg section such that as the unit is rotated and the apex portion reaches the uppermost position, the contents therein separate in unequal portions. The separation of the contents in unequal portions forces a lateral cross flow of material as rotation continues.

17 Claims, 5 Drawing Figures

BLENDING APPARATUS

BACKGROUND OF THE INVENTION

This invention relates to material mixing or blender devices for use in various industries, and more particularly to such apparatus as intended for use in solid-solids or liquid-solids blending operations.

In the prior art, various type mixers or blenders have been developed for use in blending solid-solids or liquids-solids to achieve dry or wet blends of materials. These prior art mixers and blenders have comprised variously shaped tumbler devices with or without internal baffles, agitators, intensifiers or the like and as liquid dispersion or attrition bars.

One such prior art blender is known as a cone or double cone blender. This blender derives its name from its shape and comprises a vertical cylinder with conical ends which rotate about a horizontal axis. The double cone blender suffers from the disadvantage of symmetrical flow pattern with maximum flow at the center. This tends to fill the space mostly from the middle, leaving the material near the trunnion relatively unmixed. Consequently, excessively long mixing periods are required for blending because of poor axial flow of materials.

Another form of solid-solids blender known in the art is a ribbon blender. Such blender comprises a stationary trough-type shell fitted with longitudinal shaft on which are mounted arms supporting slender spiral ribbons. It is one of the oldest mechanical mixing devices used for solid-solids mixing. This blender is effectively used for low-density solids, materials that aerate readily and light pastes. It is not recommended for precision blending, abrasive materials, material that packs, or when frequent cleaning is required. It is also not suitable for dense materials because of excessive power requirements. Unmixed material tends to accumulate at ends and at shell wall because of blade clearance. Ribbon blenders also suffer from the disadvantage of poor axial flow of materials.

Still another form of blender is my twin shell blender developed in the late 1940's and patented July 4, 1950, under U.S. Pat. No. 2,514,126. This blender comprises two opposed simple cylinders formed into a "V". An outgrowth of the simple cylinder, the Twin-Shell overcomes discharge problems and creates additional mixing action at the center. This extra action is responsible for faster, more efficient blending action than produced by a single cylinder and relies for its primary mixing action due to intermeshing of solids at the center line.

These and various other forms of blenders are illustrated and described in Patterson-Kelley Company, Division of Taylor Wharton Co.-Harsco Corporation Bulletin PED-2, "Patterns of Precision in Processing Equipment", Copyright 1975.

The devices of the prior art have been efficient only to limited degrees for the purposes intended, especially when operating upon differently sized materials or materials of substantially different specific gravities. The ideal blender for handling solid particles would have a number of desirable qualities in perfect balance. Most important are efficient mixing action, gentle mixing action, optional intensive mixing, dust-tight operation, complete discharge, cleanability, low maintenance and installed costs.

I have unexpectedly found that these desirable qualities can be obtained in a modified twin shell blender which has been modified such that the blender is formed of two shells having unequal axial dimensions. This construction forces a cross flow pattern of materials during rotation of the shell about a horizontal axis which provides an unexpected synergistic mixing action and which dramatically reduces the mixing time over that normally experienced in conventional twin shell blenders.

It is believed that this synergistic mixing action is attributable to a substantial decrease in the static charge build-up that is normally developed from cross flow of particles and the ability to achieve full blend conditions with a minimum of work input. It is known, for example, that when mixing certain materials such as polymers and/or cosmetic powders, the surface properties of the particles effect spreading or cross flow and that these surface properties are affected by the work input or blend time. Too much work input can cause an uneven charge build-up on the particles. The net result is that a polarity condition develops which retards cross-flow. Cross flow of materials enhances the break down of this static charge condition and also minimizes its buildup. Thus, the forced effect of cross flow which minimizes mixing time also results in a lesser charge build-up which in turn further enhances cross-flow.

It is an object of the present invention to provide an improved rotating or "tumbler" type blending mill, comprising a casing structure of novel shape which when rotated produces an axial flow which is essential for attaining a precise blend.

Another object of the invention is to provide an improved blending mill for the purposes aforesaid which is of structurally simple and rugged form, and which may be fabricated in accord with a novel and economical manufacturing procedure.

Another object of the invention is to provide an improved blending mill for the purposes aforesaid which operates to provide improved efficiency and economy in material blending operations.

A further object of the invention is to provide an improved tumbler type blending mill having a gentle mixing action and which enables precise blending of materials.

Other objects and advantages of the invention will be readily apparent from the specification which provides a detailed description of the invention, particularly when taken in connection with parts throughout the several views.

Figure 1:
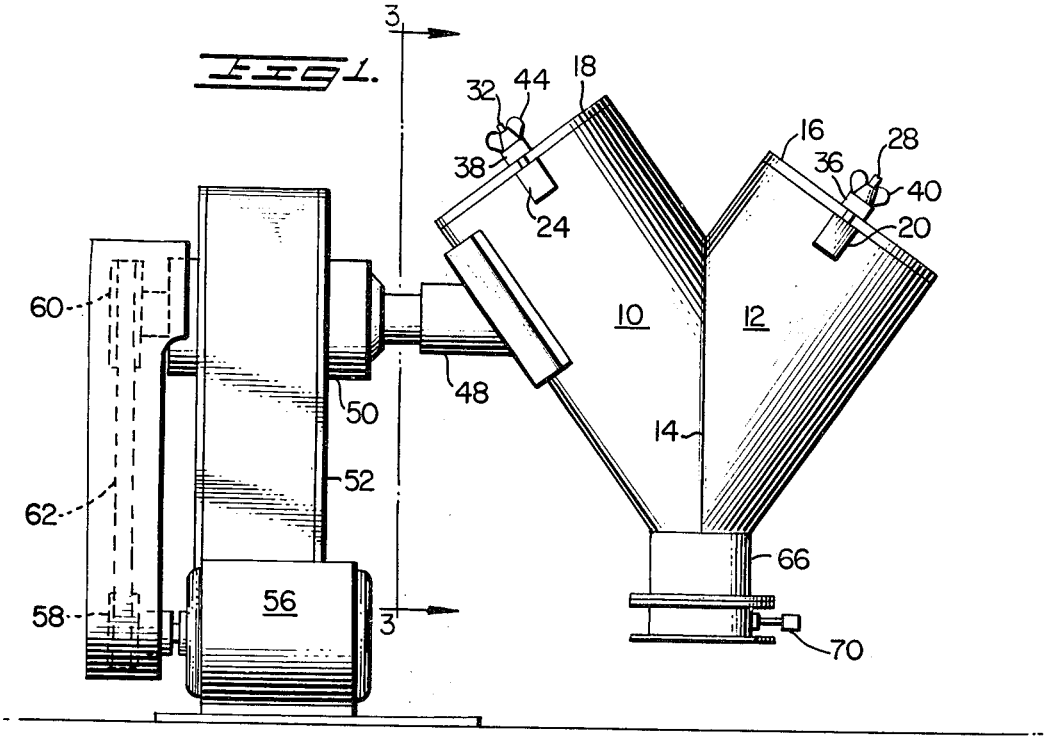
FIG. 1 is a side elevation of a blending mill of the invention.

As shown in the drawings, the blending mill of the invention may be constructed to comprise in side elevation a modification of the V-shape or twin shell blender of my aforementioned U.S. Pat. No. 2,514,126. To this end, there is provided a modified V or check-mark shaped container comprising opposite leg portions 10, 12, one of which is shorter in length than the other. Preferably, the ratio of the length of the two cylinders are approximately 4:3 such that the volume or capacity of one cylinder is approximately 35% greater than the other cylinder. Both leg portions 10, 12 are of hollow, frusto-cylindrical form relatively disposed with their cylinder axes intersecting. The common plane of the juncture between the cylinder legs 10, 12 is disposed at an acute angle of approximately 35° to 45° which intersect at the common juncture plane to the longitudinal cylinder axis of each leg. Preferably, the angle is 35° to provide maximum slope for discharge of material. The line of juncture connection between the opposite leg portions is effected by suitable means, such as by welding as indicated at 14. It should be noted that inasmuch as such blenders are frequently used in blending of pharmaceuticals, cosmetics or food products, the cylinders are preferably formed of stainless steel. However, preferably containers may be formed of other materials, either metal or plastic, in which case the juncture connection between opposite leg portions is joined by a process compatible with the material used.

The outer end of each cylinder 10, 12 is closed by suitable removable end plate or cover plate such as indicated at 16, 18, respectively. To this end, there is provided at opposite sides of each cylinder 10, 12 and adjacent its open end a pair of cooperating stud supports 20, 22 and 24, 26 for supporting, respectively, upward extending threaded studs 28, 30 and 32, 34. To lock the covers in place, cross bars 36 and 38 are provided having transversely spaced openings or slots to allow the cross bars to be positioned over the associated end plate or cover firmly held in place by threaded wing nuts 40, 42 and 44, 46, as the case may be. Removal of either cover plate allows end fitting of the respective cylinders and complete access to the interior of the cylinder for maintenance.

The container is fitted with an aligned supporting bracket 48 extending into a trunnion bearing device 50 at one side of the unit. The trunnion bearing device 50 is mounted upon a base support 52 so that the trunnion axis is disposed substantially horizontally and at the desired elevation above the mill building floor line 54. Means for rotating the container about the trunnion axis may be provided in any preferred form, such as for example, by a electric motor 56.

In the illustrated embodiment, a simplified drawing arrangement is illustrated comprising an electric motor 56 and trunnion shaft as through means pulleys 58, 60 and connecting drive belt 62. However, it will be appreciated that the unit may be rotated by any other suitable power transmission means, such as a spur gear or chain or drive arrangement in connection with any suitable power source.

Other supporting arrangements may be provided; for example, the containers may be supported in the manner shown in my aforementioned patent with trunnions at opposite sides in which case, the trunnion may be of hollow form and connected to a suitable conduit for introduction of liquid or solid materials therethrough when the mill is stationary or rotating.

The material inlet and outlet arrangement for the modified V-cylinder unit of the present invention may be of any preferred form. For example, there may be provided, as shown in the drawing, a material inlet port at either or both open ends of the cylinder which are conveniently closed by associated and detachable cover plates 16, 18. A blended material inlet/outlet device may be provided in any suitable form such as a collar 66 at the apex portion of the unit in conjunction with any suitable valve device as indicated at 68 arranged to be manually controlled as by a hand lever 70. Thus, with the blender stopped in the position thereof shown in FIGS. 1–2, one or both of the cover plates 16, 18 may be removed and material to be blended may then be loaded into the cylinder legs 10, 12 as from chutes leading from bins or elevators discharging thereabove. Then, with the covers in place the blender is rotated slowly for sufficient time to provide the desired blending of the contents whereupon it may again be stopped in the attitude thereof shown in the drawing and the valve 68 opened to permit drainage of the processed material from the mill into any suitable receptacle or conveyor therebelow. However, it will be appreciated that the filler and discharge openings and suitable cover devices therefor may be readily provided at any other positions on the unit in lieu of the arrangements illustrated, as may be preferred in view of material handling considerations externally of the mill.

Figure 4:
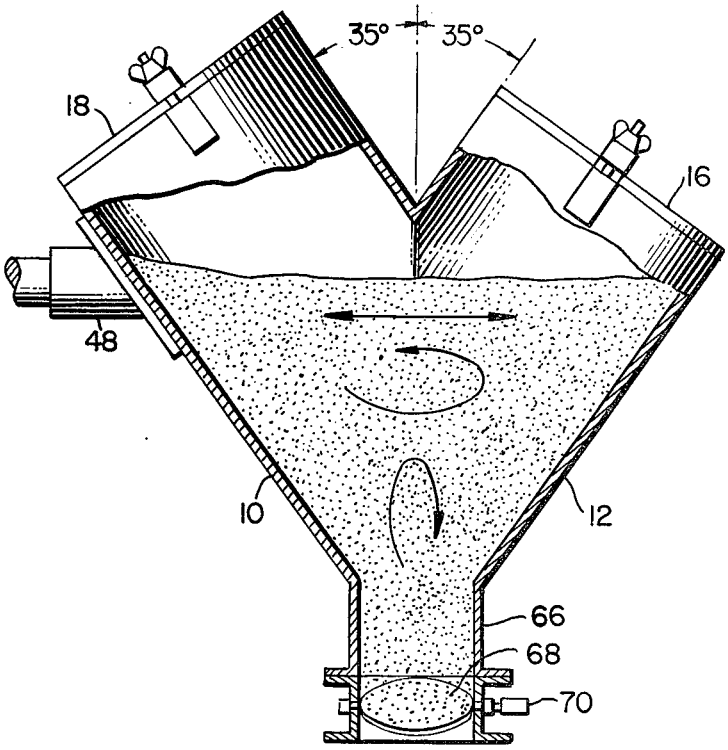
FIGS. 4 and 5 are diagrammatic illustrations of the material blending flow paths therein at different phases of the tumbling operation of the mill.
Figure 5:
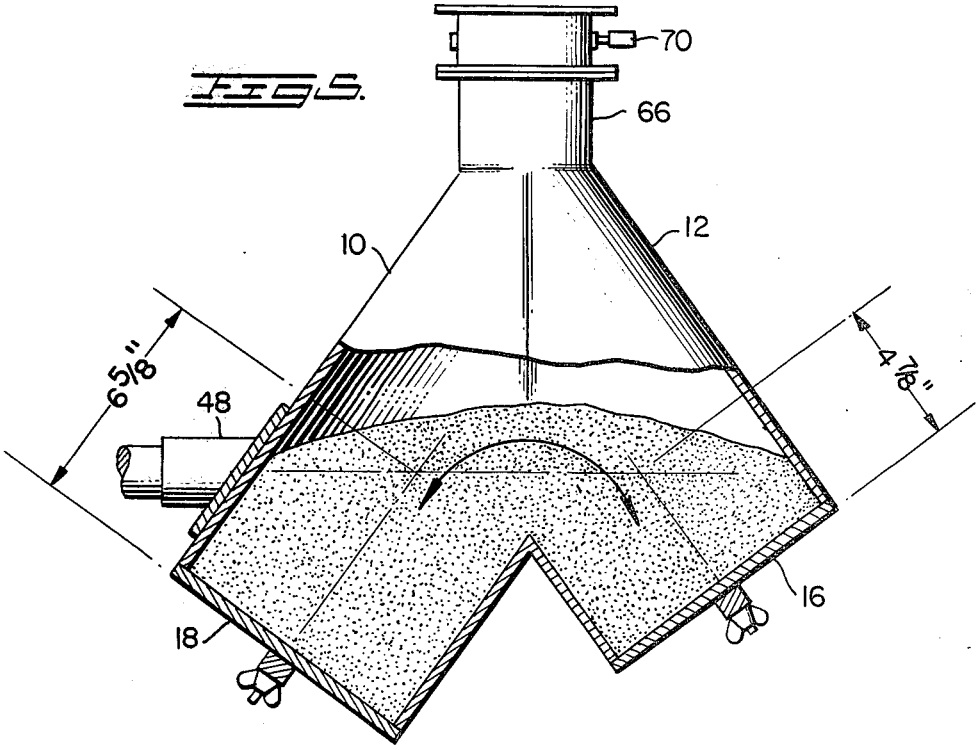

The cylinder legs 10, 12 are mounted upon trunnion bearings providing for rotation of the unit about a horizontal axis such that the cylinder legs extend obliquely to the horizontal axis which is disposed substantially normal to the plane of intersection of the two cylinder leg portions of the unit. Hence, upon rotation of the unit about the trunnion axis the loose material within the unit is tumbled alternately toward the closed end portions of the cylinder legs as shown, diagrammatically in FIG. 5 and toward the apex portion of the container as shown in FIG. 4. For example, as the container rotates so as to bring the apex portion thereof to an elevation above the closed leg portions, the loose material within the apex portion of the container is thereby tumbled over and directed to slide downwardly toward the crotch or ridge portion defined by the juncture of the cylinder legs. This ridge portion then operates to separate the downwardly sliding load into two unequal parts and to divert them to flow in obliquely lateral and downward paths toward the closed ends of the cylinder legs as illustrated in FIG. 5. Then, as rotation of the unit continues, the closed end portions of the unit are carried up again into position at an elevation above the apex portion of the device, whereupon the unequal volumes of loose material then occupying the two closed end portions of the unit are tumbled over and commence to slide downwardly in obliquely convergent paths as pictured in FIG. 4.

Thus, portions of the materials moving toward the crotch and the apex portions of the unit simultaneously from opposite leg portions thereof are positively shifted or forced laterally so as to drive into and through each other and thereby effect an improved blending operation. Hence, the operation of the device may be described as alternate mixing of the load materials into one batch and then separating the mixture into two batches of unequal volume and subsequently remixing the two batches and again separating the remixed batch into two different volume batches. Because of the separation into unequal volume batches, the load materials are given additional lateral sliding motions over and above that which would be given in conventional twin shell blenders, as well as tumbling or overturning and folding movements of elevated portions of the load relative to portions of the load still remaining at lower elevations. In the case of the present invention the above described additional lateral displacements are obtained constant tumbling and folding and sliding actions of the load in response to rotation of the unit.

It should be noted that inasmuch as cylinder leg 12 is shorter than cylinder leg 10, when the unit is rotated so as to bring the apex portion thereof to an elevation above the closed leg end portions as shown FIG. 5, a greater proportion of the material to be mixed or blended falls into the longer cylinder leg 10. As rotation of the unit continues, the loose material from the two end portions slide downwardly again and merge together as shown in FIG. 4. As a consequence of the uneven volume of the cylinder legs, every time the unit is rotated 180 a fixed amount of material is forced to flow from one leg to the other across the vertical center line causing an axial exchange or lateral cross flow of material. While the mixing time will vary depending on quantity and type of material to be mixed and speed of mixing, generally the modified twin shell blenders of the present invention having cylinder legs of unequal length provides better than a four fold decrease in mixing time over conventional twin shell blenders of the type described, for example, in my U.S. Pat. No. 2,514,128 and at least a fifteen fold decrease in mixing time over double cone blenders.

Figure 2:
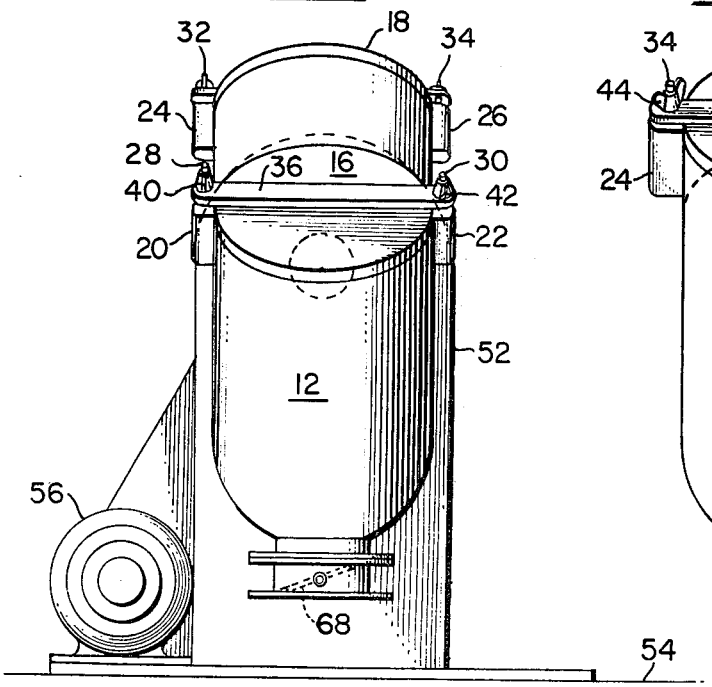
FIG. 2 is an end elevation of the blending mill shown in FIG. 1.
Figure 3:
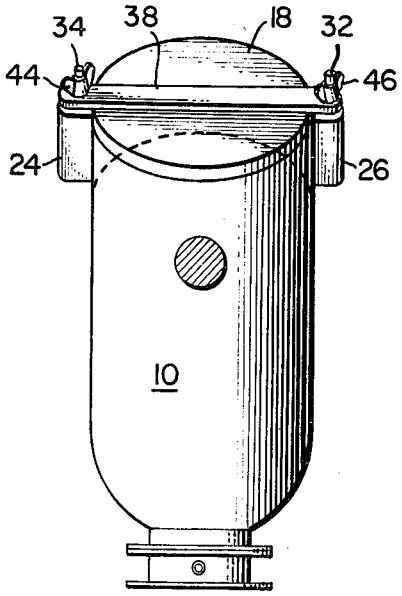
FIG. 3 is a side elevation of a blending mill taken along lines 3—3 of FIG. 1 with the supporting brackets cut away for clarity.

To demonstrate and observe the synergistic effect and dramatic improvement on mixing time of my modified twin shell blender, an experiment was conducted simultaneously comparing the blending of like amounts of uncolored and colored granulated salt. A portion of the uncolored granulated salt was predyed red for visual effect. A modified 8 quart twin shell blender was constructed as shown in FIGS. 1–3. The unit was fabricated from 7½" I.D. clear plexiglass cylindrical tubing, the legs joining at an angle of 35 with respect to the plane passing through the juncture of the two legs. The legs had an axial length ratio of 4:3, the longer leg being 12" in length. The cylinders were end loaded from opposite ends such that the mean length of the material in the longer leg with apex upward was 6⅝", while the mean length of the material in the shorter leg was 4⅞". Thus, the shorter leg held approximately 16% less material than the longer leg.

The modified twin shell blender was first filled with three (3) cups of undyed white granulated salt in the longer cylinder leg, after which two cups of granulated salt dyed red was placed in the shorter leg. Then three additional cups of the granulated undyed salt was placed in the longer leg and one cup of the dyed salt was placed in the shorter leg. Finally, four additional cups of undyed salt were placed in the longer cylinder leg. All materials were loaded from the ends by removing the cover plates which were refastened after loading was complete. The disproportionate quantities of dyed and undyed salt, along with alternate filling of the cylinder legs and side loading was done to present the most difficult loading condition. Obviously, the material could be center loaded through the apex port such that a certain amount of intermixing would occur with a consequent reduction in mixing time, but such conditions were avoided.

A similar loading technique was followed for an 8 quart side loading double cone blender likewise constructed of clear plexiglass to observe the mixing. The double cone loader was from the right and left side with three, two, three, one and four cups, respectively, of granulated salt. The right side received the white salt and the left side received the red salt.

Similarly, a conventional 8 quart twin shell blender as described in my aforementioned U.S. Pat. No. 2,514,126 was fabricated of clear 7½" I.D. plexiglass tubing loaded with dyed and undyed salt in a manner identical to that followed in loading the modified twin shell blender.

All materials were taken from the same bag and the same cup was used for measuring. Each cup was leveled before pouring such that the same quantities were measured. All units were connected to a common source of power, started simultaneously and driven at the same rpm and visually observed for mixing action.

At the end of one minute, the modified twin shell blender showed moderate mixing of the red and white salt to the left and right of center. A color separation along the vertical plane at the juncture of the two cylinders could be observed when the units were stopped, but the red and white were sufficiently blended to give a pink color on each side.

The double cone unit showed very little mixing effect.

The conventional twin shell blender unit showed a definite vertical color separation which could be observed even while the unit was rotating. One side was predominantly pink and the other side was predominantly white with gradual dispersion of red salt outward from the crotch.

At the end of the three minutes, the modified twin shell blender showed complete mixing with the contents of each shell being uniform in color. The double cone blender showed little mixing effect after three minutes, while the contents of the conventional twin shell blender still showed a striking color separation line between left and right hand sides. No change was observed in the modified twin shell blender after another minute of mixing and power to the motor was removed.

At the end of four minutes, the color of the materials in the conventional twin shell unit showed that a definite contrast in shade still existed between the contents of the left hand and right hand sides of the conventional twin shell mixer.

With continued rotation of the conventional twin shell mixer through six minutes, changes in color shading could still be observed, and the vertical color line separation was still distinct. The double cone blender showed little change in appearance.

At the end of seven minutes, the color separation line in the conventional twin shell unit started to become fuzzy, while a definite color movement became apparent in the double cone unit although it was obviously far from being anywhere near blended.

At the end of nine minutes, the material in each cylinder leg of the conventional twin shell unit exhibited a uniform color, but a slight difference in shade was apparent. The vertical color separation line appeared to shift obliquely from the center. The double cone unit began to show visible signs of mixing although the materials were still distinctly dark red and white.

At eleven minutes, the materials in the conventional twin shell blender were almost fully blended with a slight shade difference still apparent. At twelve minutes this shade difference disappeared and the color of the contents appeared to be identical to that of the modified twin shell blender. The rotation of the double cone blender was continued for one hour before a substantial equal mix was obtained.

The following table charts time versus degree of blend or mixing for the three different blenders.

| Time in Mixer min. | Degree of Mixing: Modified Twin Shell | Conventional Twin Shell | Double Cone |
|---|---|---|---|
| one | moderate | little | very little |
| three | complete | some | very little |
| four | complete | moderate | little |
| seven | — | moderate | little |
| nine | — | moderate | little |
| twelve | — | complete | some |
| thirty | — | — | moderate |
| sixty | — | — | complete |

It will be appreciated that the invention provides a blender which forces a lateral displacement of materials therein in a novel manner and with improved blending results and efficiency without corresponding increase of power consumption. It will, of course, be understood that various agitator devices or the like may be installed interiorly of the material container, if preferred, in connection with the handling of any specific material or problem; and that employment of such agitator devices would provide additional local agitation of the material load as controlled generally by the shape of the casting unit as explained hereinabove. Likewise, the liquid dispersion bars may be utilized interiorly for liquids/solids blending.

Although only one form of the invention has been shown and described in detail, it will be readily apparent to those skilled in the art that various changes may be made therein without departing from the true spirit or full scope of the invention for which reference should be made to the appended claims.

I claim:

1. A blending apparatus comprising a material container including a pair of hollow mixing legs joined together at one end along a common plane to form an apex portion, said hollow legs being divergent from said common plane along intersecting axes each of which forms an acute angle with said common plane, one of said legs being greater in length than the other leg, means for mounting said container for rotation about a rotation axis in the plane of the intersecting axes of said legs, and means for rotating said container about said rotation axis.

2. Apparatus as set forth in claim 1 wherein the ratio of length of said legs is approximately 4:3.

3. Apparatus as set forth in claim 1 wherein the volumetric capacity of the longer leg is approximately 35% greater than the shorter leg.

4. Apparatus as set forth in claim 1 wherein the acute angle formed between the axis of each leg and the common plane is between approximately 35° and 45°.

5. A dual shell blending apparatus comprising a generally V-shape container having elongate first and second hollow cylindrical shells of different mean lengths joined together at one end along a common plane and diverging therefrom, means for mounting said container for rotation about an axis lying within the plane of the axes of elongation of said shells but extending in a direction obliquely transverse to said axes, and a material loading opening and detachable cover means therefor at the other end of at least one of said cylindrical shells.

6. Apparatus as set forth in claim 5 wherein the ratio of length of said legs is approximately 4:3.

7. Apparatus as set forth in claim 5 wherein the volumetric capacity of the longer leg is approximately 35% greater than the shorter leg.

8. Apparatus as set forth in claim 5 wherein the acute angle formed between the axis of each leg and the common plane is between approximately 35° and 45°.

9. A blending apparatus comprising in one view a generally modified V-shape container having an apex portion formed by first and second side leg portions joined together at one end along a common plane, said side leg portions being of unequal mean length at least one of said side leg portions having a material loading opening, a discharge outlet at said apex portion and means for mounting said container for rotation about an axis lying within the plane of the axes of said leg portions but extending in a direction transverse to said axes.

10. Apparatus as set forth in claim 9 wherein the ratio of length of said legs is approximately 4:3.

11. Apparatus as set forth in claim 9 wherein the volumetric capacity of the longer leg is approximately 35% greater than the shorter leg.

12. Apparatus as set forth in claim 9 wherein the acute angle formed between the axis of each leg and the common plane is between approximately 35° and 45°.

13. A blending apparatus comprising a generally modified V-shape container having first and second side legs joined together at one end along a common plane and diverging therefrom along intersecting axes, said legs forming a closed apex portion at said one end, detachable cover means for closing the other end of said leg portions, a discharge outlet connected at said apex portion, said side legs being of unequal volumetric capacity and means for mounting said container for rotation about an axis extending in the plane of the intersecting axes of said leg portions.

14. Apparatus as set forth in claim 13 wherein said legs are of unequal mean length and the ratio of length of said legs is approximately 4:3.

15. Apparatus as set forth in claim 13 wherein the volumetric capacity of one leg is approximately 35% greater than the other leg.

16. Apparatus as set forth in claim 13 wherein the acute angle formed between the axis of each leg and the common plane is between approximately 35° and 45°.

17. A blending apparatus comprising in side elevation a generally check-mark shape container having first and second hollow elongate cylindrical shell portions of different lengths having their elongation axes intersecting and disposed in diverging directions and being joined at one end in a common plane to form an apex portion, and means for mounting said container for rotation about an axis obliquely intersecting said elongation axes of said shell portions.

* * * * *